United States Patent [19]

Fitch et al.

[11] 4,331,086

[45] May 25, 1982

[54] HOT GAS RECYCLE FOR STARVED-AIR COMBUSTOR

[75] Inventors: Robert E. Fitch, Kent; Gordon H. Tucker, Enumclaw, both of Wash.

[73] Assignee: The Boeing Company, Seattle, Wash.

[21] Appl. No.: 148,362

[22] Filed: May 9, 1980

[51] Int. Cl.[3] ..... F23B 5/02; F23C 9/00

[52] U.S. Cl. ..... 110/204; 110/205; 432/72; 432/105

[58] Field of Search ..... 110/203-205, 110/210-212, 214; 236/15 E; 432/72, 105

[56] References Cited

U.S. PATENT DOCUMENTS

| | | | |
|---|---|---|---|
| 2,603,195 | 7/1952 | Permann | 110/205 |
| 3,776,151 | 12/1973 | Wilson | 110/204 |
| 3,785,306 | 1/1974 | Jaget . | |
| 3,854,455 | 12/1974 | Carson et al. | 110/205 |
| 3,916,807 | 11/1975 | Eiki | 432/105 |
| 3,917,444 | 11/1975 | Carthew | 432/72 |
| 4,037,543 | 7/1977 | Angelo . | |
| 4,060,042 | 11/1977 | Banaldi et al. . | |

FOREIGN PATENT DOCUMENTS

| | | | |
|---|---|---|---|
| 231123 | 1/1964 | Austria | 98/415 V |

*Primary Examiner*—Henry C. Yuen

[57] ABSTRACT

A hot combustion gas recycle apparatus for a starved-air combustor for mixing hot combustion gas with significant amounts of air to heat the air. The heated air is injected as underfire air into the first combustion zone of the combustion chamber to heat and to dry the fuel in the fuel bed as an aid to combustion efficiency. The recycle device includes a temperature control system for controlling the ratio of gas to air and a control valve to completely shut off the flow of combustion gas to the recycle device if the gas and air mixture exceeds a preset maximum.

2 Claims, 5 Drawing Figures

123
119
203
210
205
123
210
207
213
117
115
217
121
201
209

123

208
203
213
125
213
201
209
208
217
209

HOT GAS RECYCLE FOR STARVED-AIR COMBUSTOR

BACKGROUND OF THE INVENTION

In the last century, much of the world's energy needs have been fulfilled by hydrocarbon fuels which provided a convenient, plentiful, and inexpensive energy source. The current rising costs of such fuels and concerns over the adequacy of their supply in the future has made them a less desirable energy source and has led to an intense investigation of alternative sources of energy. The ideal alternative energy source is a fuel which is renewable, inexpensive, and plentiful, with examples of such fuels being the byproducts of wood, pulp, and paper mills, and household and commercial refuse.

The use of alternative energy sources is not problem-free, however, since there is a concern over the contents of the emissions from the combustion of such fuels as well as the environmental ramifications of acquiring and transporting the fuel and disposing of the residue of combustion.

One promising prior art device for using such alternative energy sources, while maintaining a high degree of environmental quality, is the starved-air combustor wherein the air supplied for combustion is controlled in order to control temperature conditions and the rates of combustion are controlled to consume the fuel entirely. Such starved-air combustors are capable of burning various types of fuel and producing significant amounts of heat which can be employed for any number of purposes including the production of process steam for use in manufacturing and in the generation of electricity.

Starved-air combustors, as previously known and operated, have not been entirely satisfactory in both entirely consuming the combustible elements of the fuel at high throughput while not producing noxious emissions. This problem results, in part, from the use of such starved-air combustors to burn a wide variety of fuels some of which may be non-homogeneous, e.g., household or commercial refuse. It has not been possible in the previously known starved-air combustors to tailor in a real time manner the combustion processes to the type of fuel being combusted in order to maximize the efficiency of the combustor while minimizing the generation of air pollutants. While the pollution problem can be solved to a degree by the utilization of scrubbers and other antipollution devices, such mechanisms are very expensive and their cost may militate against the use of alternative energy sources.

SUMMARY OF THE INVENTION

It is, therefore, an object of the present invention to provide a starved-air combustor capable of efficiently utilizing many different types and quantities of fuel.

Another object of this invention is to provide a starved-air combustor which does not release noxious pollutants into the atmosphere.

Yet another object of this invention is to provide a starved-air combustor which is capable of combusting to a very high degree the percentage of all combustible materials provided to it as fuel.

Still another object of this invention is to provide a starved-air combustor with the ability to recycle hot combustion gases produced by the combustor in a mixture of air to the first combustion zone of the combustor to heat and to dry the fuel in the combustor.

To achieve these objects, and in accordance with the purpose of the invention, as embodied and broadly described herein, the starved-air combustor comprises a combustion chamber having an inlet end for receiving fuel, the combustion chamber for combusting the received fuel to produce hot combustion gases and combustion residue, the combustion chamber further including an outlet end for discharging the combustion gases, means in the combustion chamber for conveying received fuel from the inlet end towards the outlet end, a plenum adjacent to the combustion chamber and communicating with the chamber through at least one aperture located beneath the fuel in the combustion chamber, means for the receiving hot combustion gases produced by the combustion chamber and for further combusting any combustible material entrained in the combustion gases to produce a hot non-combustible gas, means for selectively mixing a portion of the non-combustible gas with selected amounts of air to heat the air and for supplying the mixture to the combustion chamber through the aperture to heat and to dry the fuel in the chamber, and means for sensing the temperature of the mixture of air and non-combustible gases and for controlling the amount of air mixed with the non-combustible gas to maintain preselected temperature range for the mixture.

The accompanying drawings, which are incorporated in and constitute a part of this specification, illustrate an embodiment of the invention and, together with the description, serve to explain the principles of the invention.

DESCRIPTION OF THE PREFERRED EMBODIMENT

Figure 1:
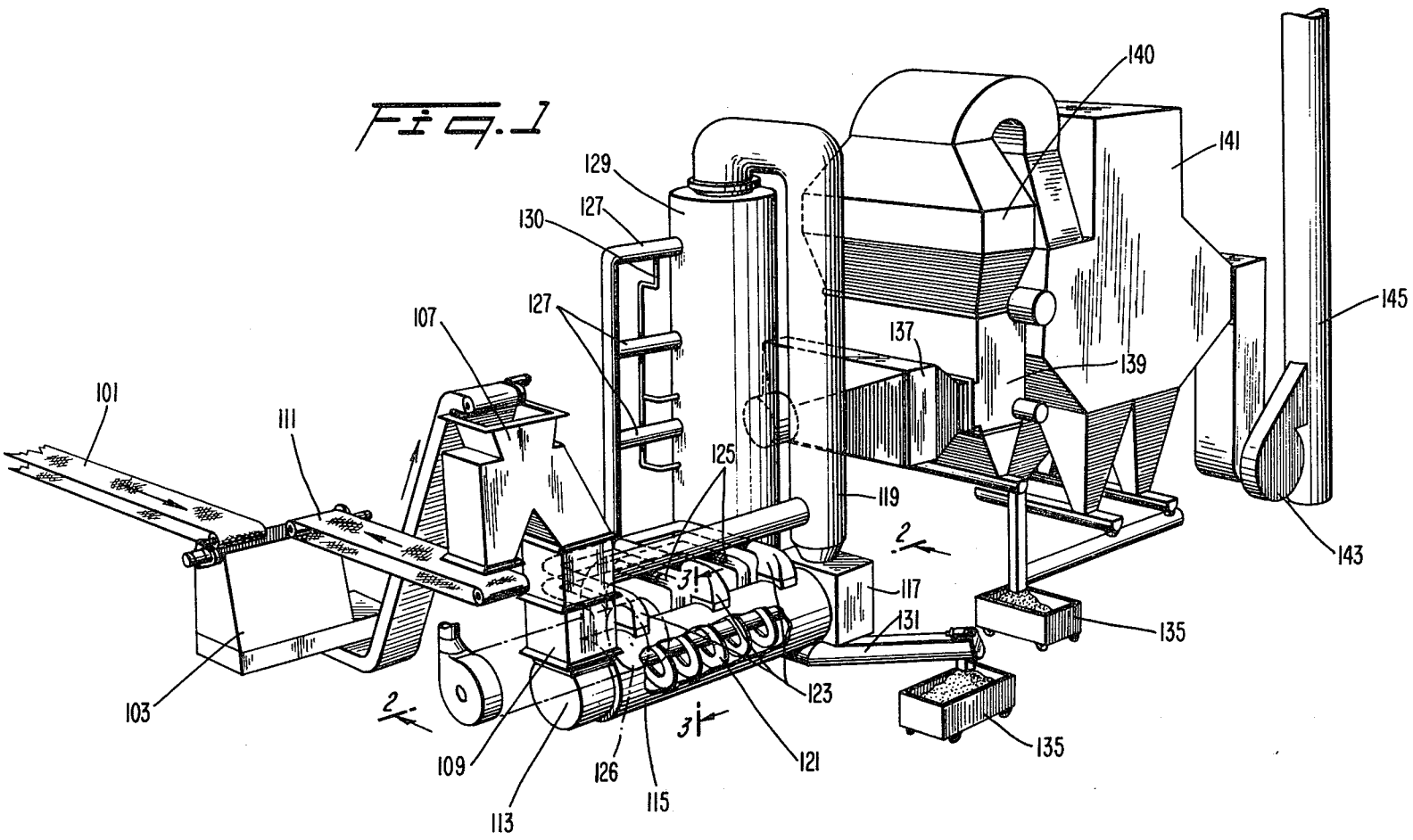
FIG. 1 is an illustration of the starved-air combustor of the instant invention coupled between a fuel supply system and a system which produces process steam from the heat produced by the starved-air combustor.

FIG. 1 illustrates an embodiment of a starved-air combustor according to the present invention coupled between a refuse feeder system and a steam generation system. As embodied herein, the refuse supply comprises a supply conveyor 101 for conveying fuel, in this instance refuse, from a receiving building (not shown) and one or more storage silos (not shown). The receiving building and storage silos are to insure that an adequate supply of fuel can be supplied to the combustor in order to permit the combustor to run at peak efficiency. In the illustrated embodiment, it is contemplated that the supply conveyor 101 would supply fuel to the fuel surge and recirculation bin 103 at a rate of at least fifteen tons per hour and that the capacity of the combustor system would range from 150 to 500 pounds per minute.

The fuel surge and recirculation bin 103 comprises an additional means for insuring that a constant and adequate supply of fuel is available to the combustor. The bin 103 could, for example, contain at least 10 minutes capacity of fuel, i.e., approximately 2.5 tons, which is received at the top of the bin 103 and supplied through the bottom of the bin 103 to the feed conveyor 105. Feed conveyor 105 supplies the fuel to a splitter 107 which may either direct the fuel into the feed and weigh bin 109 or, when the feed and weigh bin 109 is filled to capacity, to the return conveyor 111 for return to the fuel surge and recirculation bin 103. The feed and weigh bin 109 is calibrated to supply a constant weight of fuel at the inlet end 113 of a refractory-lined combustor 115 at such time that the first flight of an auger 121 within the chamber 115 has been rotated into a fuel receiving position. Within the starved-air combustor 115 there is provided a well-known oil igniter (not shown) in the input end of the combustion chamber 115 serve as a means for initially igniting the fuel upon start up of the starved-air combustor.

U.S. Pat. No. 4,009,667 issued to *Robert C. Tyer et al* on Mar. 1, 1977, illustrates an appropriate embodiment for a rotatably-driven auger comprised of a rotatable, water-cooled horizontal shaft supporting a spiral flight of decreasing pitch from the input end of the auger to the output end. It is contemplated in the instant system that the speed of the auger would range from 0.3 to 1 rpm. An appropriate oil igniter would comprise an oil burner having its flame extending into the input end of the combustor 115 to heat and to ignite the initial load of fuel supplied by the feed and weigh bin 109. It is contemplated that such an oil igniter would be capable of burning oil fuel at a rate of approximately six gallons per hour at two pounds per square inch pressure.

The combustor 115 has an output end 117 connected to a duct 119 which feeds the top of an afterburner 129. The combustor 115 also includes air supply means 123 for supplying underfire air and conduits 125 for supplying overfire air. This air is provided by a fan 126 (shown in phantom) which also supplies air through conduits 127 to the afterburner 129. Alternatively, a separate fan or fans may be provided to supply underfire air, overfire air, and air to the afterburner 129. A small air distributor 130 is connected to the upper conduit 127 to supply air into the afterburner 129 both at and below its midpoint.

Afterburner 129 is provided, in part, as a secondary combustor chamber which mixes the air supplied by the conduits 127 with the gaseous and entrained solid particle output of the combustor from the outlet end 117 to combust all combustible material in the gaseous output and, in part, to separate suspended ash and non-combustible solids from the hot non-combustible gas. Both the non-combustible material from the afterburner 129 and the combination residue from combustor 115 are fed through conduit 131 to an ash collector 135. The hot non-combustible gas exits into a superheater 137 from which it is supplied to a waste heat boiler 139 and economizer 140 to produce, in this case, process steam. An electrostatic precipitator 141 removes any additional solids from the now cooler non-combustible gas exiting from the waste heat boiler 139 through an economizer 140 and the solid material is conveyed to an ash cart 135. From the precipitator 141, the non-combustible gas is drawn by a fan 143 and expelled from stack 145. Upon entering into the fan 143 the temperature of the gas is approximately 300 to 400 degrees Fahrenheit and the fan 143 is of sufficient strength to exert a negative pressure in the system from the combustor 115, the afterburner 129, superheater 137, waste heat boiler 139, economizer 140 and precipitator 141.

A starved-air combustor is specifically designed to operate at low temperatures under air-deficient conditions. When the starved-air combustor, however, receives very wet fuel, the temperature within the combustor is insufficient to provide additional energy which can be used to evaporate moisture quickly from the received wet fuel and to heat and to dry the fuel and to provide for its rapid ignition and efficient combustion. In such an instance, more of the residence time of the fuel in the combustion chamber is devoted to drying and less to combustion with the result that the capacity and efficiency of the machine are decreased.

There have been many attempts in the prior art to effect a partial solution of this problem by passing air through tubes embedded in the refractory lining of the combustion chamber or to heat the air in a separate heat exchanger with flue gas produced by the combustor. The heated air is injected into the fuel bed in the combustion chamber in an attempt to dry the fuel. The result of such devices has been to heat the air to limited degree at the expense of additional equipment including a fan with extreme temperature capabilities. These approaches have not proved completely satisfactory.

The hot gas recycle apparatus of the instant invention consists of a device for withdrawing hot combustion gas discharged from the afterburner and blending the gas with air in the proportion necessary to provide a mixture with a temperature of at least 500° F. and to inject the mixture as underfire air into the first zone of the combustion chamber. This approach provides air at approximately 500° F. only slightly vitiated ($O_2$ concentration of 15–18%) which has a strong capacity to heat and to dry the fuel in the combustion chamber by both heating the refractory on which the fuel lies and by injecting the hot air directly into the fuel.

Figure 2:
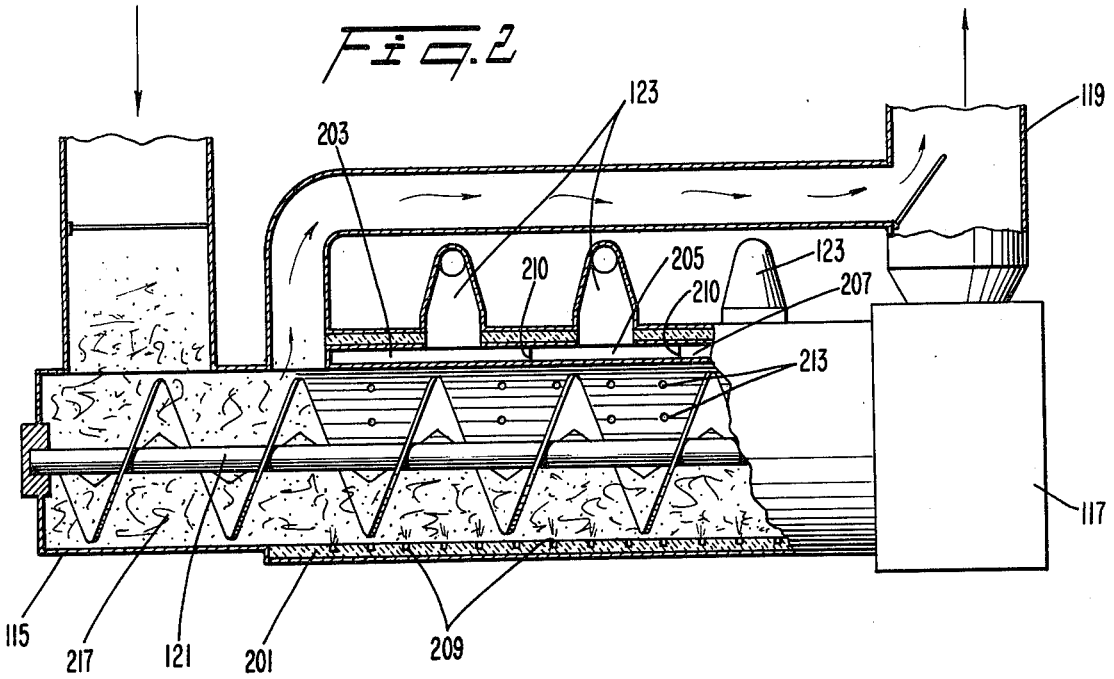
FIG. 2 is an enlarged cross-sectional view of the combustor of FIG. 1 taken along lines 2—2 and illustrating the combustion chamber of the starved-air combustor system.

As illustrated in FIG. 2, the starved-air combustor of the instant invention comprises a combustion chamber 115 having an inlet end 113 for receiving fuel and an outlet end 117 for discharging combustion gases produced by the combustion of the received fuel in the combustion chamber 115. Within the combustion chamber 115 there resides means for conveying the received fuel from the inlet end 113 towards the outlet end 117. As embodied herein, this means comprises an auger 121 eccentrically positioned within the combustion chamber 115. As explained in the above-referenced Tyer et al patent, rotation of auger 121 moves the fuel from the inlet end 113 toward the outlet end 117. The fuel bed 217 resides within the combustion chamber 115 and decreases in bulk as it extends towards the outlet end 117 due to the combustion of the combustible material within the fuel and the production of the combustion residue and combustion gases.

The combustion chamber 115 is lined with a layer of refractory material 201. The combustion chamber 115 receives underfire air injected into the fuel bed 217 from plenums 203, 205, and 207 located contiguous with one wall of the combustion chamber 115. A series of tubes 208 (FIG. 3) terminating in injectors 209 permit air introduced into the plenums 203, 205, or 207 to pass into the combustion chamber 115. As shown in FIG. 2, the plenums 203, 205, and 207 are separated by sealing stops or gaskets 210.

Figure 3:
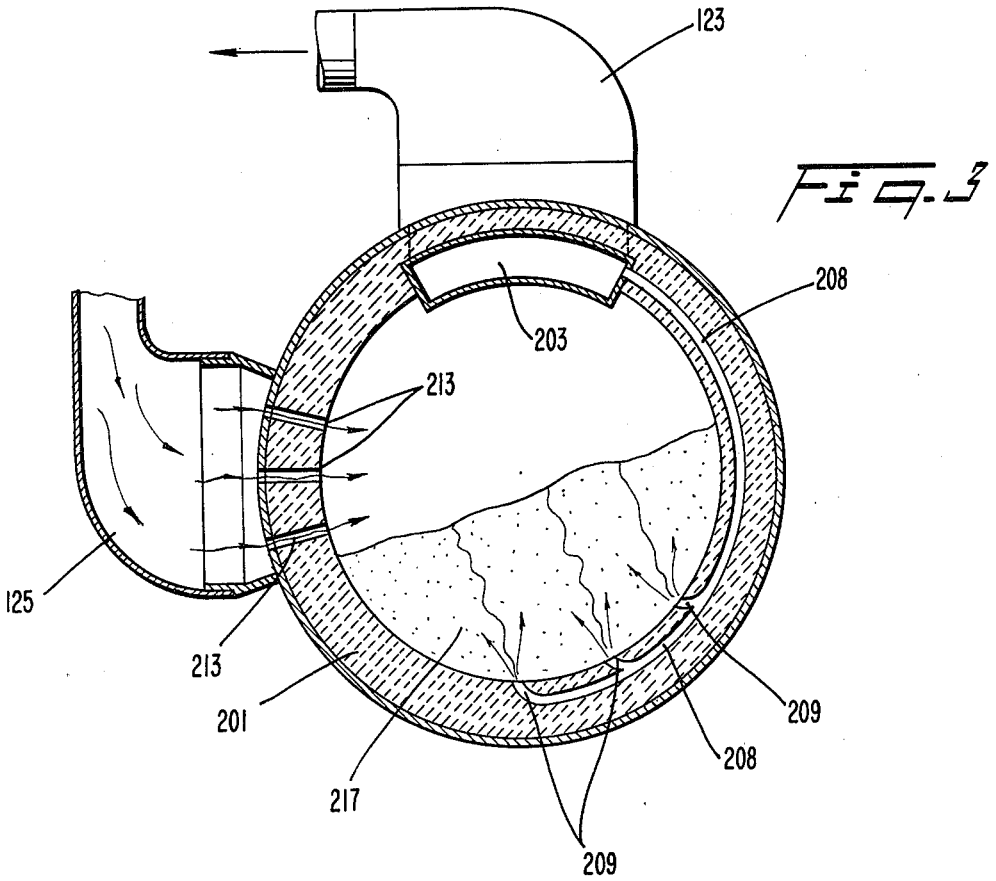
FIG. 3 is an enlarged cross-sectional view of the combustor of FIG. 1 taken along the lines 3—3.

The combustion chamber 115 receives overfire air from air supplies 125 which communicate with associated plenums such as plenum 211 in FIG. 3. The overfire air is supplied from the plenums into the combustion chamber through ports 213 extending through the layer of refractory material 201. The injection of overfire air into the combustion chamber 115 does not, however, comprise a feature of the instant invention.

FIG. 3 shows combustion chamber 115 in cross-section with auger 121 removed. Plenum 203 receives its air from underfire source 123 and the received air is transferred to injectors 209 through refractory-embedded tubes 208 for discharge into fuel bed 217.

The instant starved-air combustor further comprises means for receiving the hot, combustion gases from the combustion chamber and for further combusting any combustible material entrained in the combustion gases to produce hot, non-combustible gases. As embodied herein, this receiving and combusting means comprises afterburner 129 (FIG. 1) connected to the outlet end 117 of the combustion chamber 115 by means of duct 119. The instant exhaust gas recycle device is operable with many different types of afterburners but reference can be made to U.S. Patent Application Ser. No. 148,361, filed on even date herewith in the name of Gordon H. Tucker and entitled "After Burner for Combustion Starved-air Combustor Fuel Gas Containing Suspended Solid Fuel and Fly Ash." This patent application is assigned to the assignee of the present invention.

The output of the afterburner 129 is a gas having a temperature between 1500°–2000° F. This gas is supplied, as previously explained, to superheater 137 but, as contemplated in the instant invention, a portion of this gas is also supplied to a means for selectively mixing the gas with selected amounts of air to heat the air and for supplying the mixture to the underfire air inlet 123 of plenum 203 for injection into the combustion chamber through the injectors 209 embedded the layer of refractory material 201.

Figure 4:
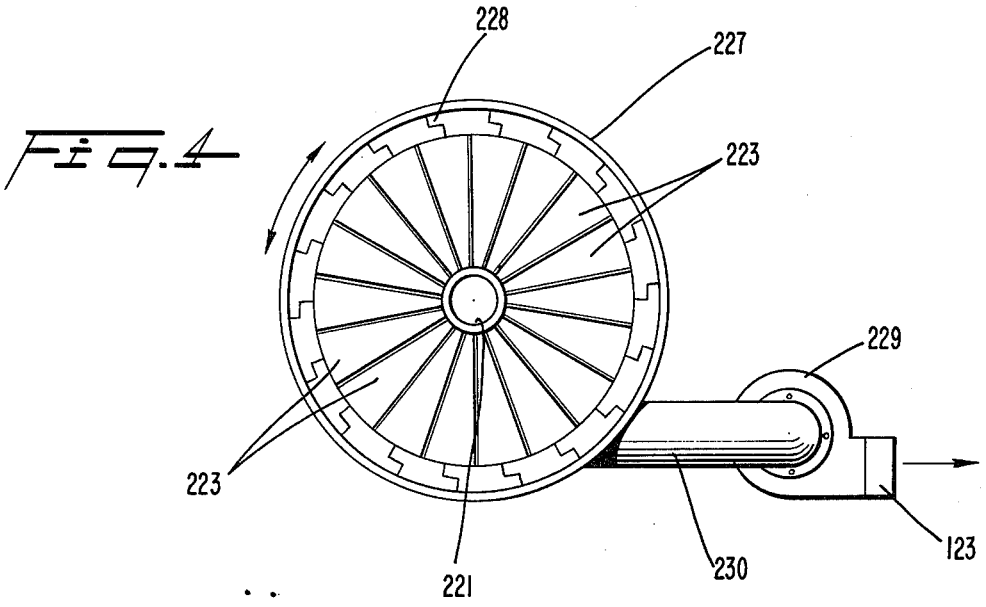
FIG. 4 is a top view of the hot gas recycle apparatus of the instant invention.
Figure 5:
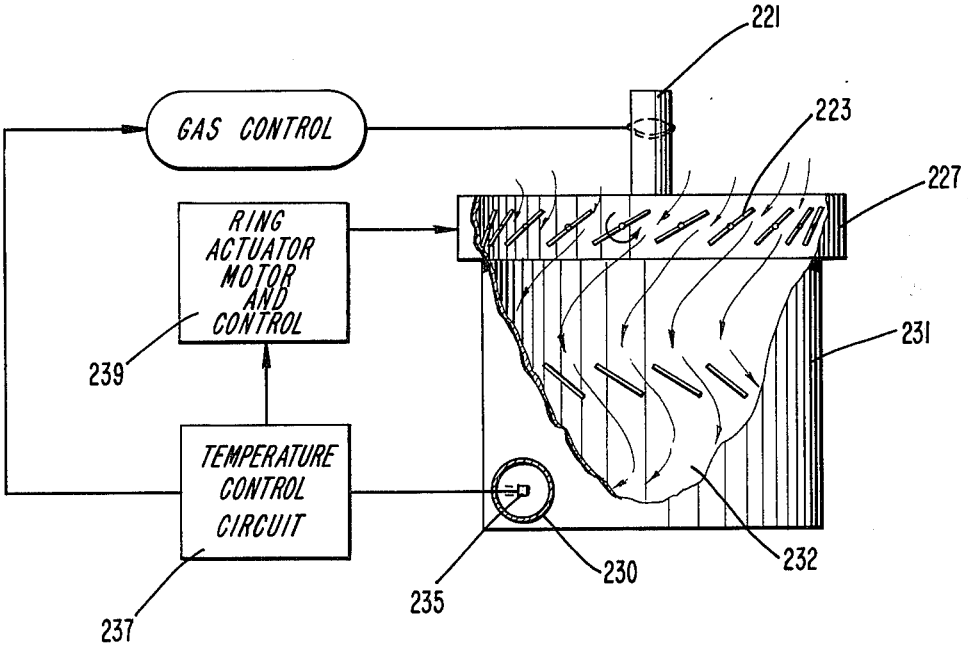
FIG. 5 is a side view of the hot gas recycle apparatus of FIG. 4.

This mixing and supplying means is illustrated in FIGS. 4 and 5 and, as embodied herein, comprises a mixing chamber having a central inlet 221 for receiving the hot gases from the discharge of the afterburner 129. Surrounding the inlet 221 are radial vanes 223 rotatable around axes 225 to permit selected amounts of air to enter the mixing chamber. As shown in FIG. 4, the vanes 223 are in their fully closed position and, therefore, would not permit the entry of air into the mixing chamber.

Surrounding the ends of the radial vanes 123 is a ring actuator 227 concentrically rotatable about the inlet 221. Rotation of the ring actuator 227 controls the opening and closing of the radial vanes 223 by appropriate links 228 which cause the vanes 223 to rotate upon rotary displacement of the actuator 227 to control the entry of air into the mixing chamber. The mixing chamber further includes an outlet 230 for discharging the mixed combustion gases received through inlet 221 and air received through the openings through the vanes 223. A fan 229 provides the appropriate negative pressure to pull air into the mixing chamber. The inlet 123 into the first plenum 203 is connected to the output side of fan 229 such that the mixture of air and combustion gases is supplied to the plenum 203.

FIG. 5 is a side view of the mixing chamber broken-away along line 232. The side view of the vanes 223 illustrates them in a partially open position to permit air to enter the mixing chamber 231. A fixed set of radial vanes 233 is provided within the mixing chamber 231 to reverse the flow of the air and combustion gas in the chamber 231 to insure a complete mixture of the air and the gas.

The starved-air combustor further includes means for sensing the temperature of the mixture of air and non-combustible gas and for controlling the amount of air mixed with the non-combustible gas to maintain a preselected temperature range for the mixture. As embodied herein, the sensing and controlling means comprises a sensor unit 235, for example, a thermocouple, connected to temperature control circuit 237. The temperature sensor 235 produces an output signal having a magnitude reflecting the temperature of the gas exhausted from the outlet 230 of the mixing chamber 231. If the magnitude of the output signal is within the range of magnitudes corresponding to a range of acceptable temperatures for the mixture of air and gas, then temperature control circuit 237 will permit the status of the mixing chamber 231 to remain unchanged. If, however, the magnitude of the output signal of temperature sensor 235 indicates that the temperature of the mixture discharged through outlet 230 is not within the preselected range, temperature control circuit 237 supplies an appropriate outlet signal to ring actuator control 239 to control the rotation of ring actuator 227 to either further open or further close the vanes 223. If the temperature of the discharged mixture is too low, then too much air is entering the mixing chamber 231 and the ring actuator control will cause the ring actuator 227 to rotate in the direction to cause the vanes 223 to close and permit less air to enter the mixing chamber 231. If, however, the temperature of the mixture discharged through outlet 230 is too high, as sensed by temperature sensor 235, then the ring actuator control 239 will cause the ring actuator 227 to rotate in the direction to open the vanes 223 of the mixing chamber 231 to permit more air to enter the mixing chamber 231. If the temperature of the discharged mixture exceeds a certain boundary temperature, then temperature control circuit 237 will signal gas control 241 to rotate valve 243 within the gas inlet 221 to block the entry of gas into the mixing chamber 231.

In summary, the instant combustion gas recycle apparatus receives hot gases (1500°–2400° F.) from the afterburner in the starved-air combustor system of the instant invention. The top of the mixing chamber 231 has automatically controlled radial vanes 223 which open and close to modulate the amount of air drawn into the mixing chamber 231 to maintain a preset mixed gas temperature upon discharge from outlet 230 of the mixing chamber 231. The orientation of the vanes 223 is such as to impact a strong swirl to the air as it enters the box whereby the combustion gas and the air mix by sheer-generated turbulence with the inner core of air being hotter and the areas surrounding the walls of the mixing chamber 231 being cooler. With this flow pattern, a refractory lining of the mixing chamber is not required although such a refractory lining could be provided. A plurality of fixed, radial vanes 233 within the mixing chamber 231 reverses the direction of flow to further enhance mixing. The mixed gas and air exits through outlet 230 of the mixing chamber 231.

From outlet 123, the mixture is supplied as underfire air to the first plenum 203 of the combustion chamber 115 to be injected into the fuel duct 123 connected to plenum 203 to heat and to dry the fuel in the bed 217 as an aid to combustion.

It will be further apparent to those skilled in the art, that numerous modifications and variations can be made to the combustion gas recycle device of the starved-air combustor without departing from the scope or spirit of the invention and it is intended that the present invention cover the modifications and variations of the system provided that they come within the scope of the appended claims and their equivalents.

What is claimed is:

1. A starved-air combustor comprising:

a combustion chamber having an inlet end for receiving fuel, said combustion chamber for combusting said received fuel to produce hot combustion gases and combustion residue, said combustion chamber further including an outlet end for discharging said combustion gases;

means in said combustion chamber for conveying received fuel from said inlet end toward said outlet end;

a plenum adjacent to said combustion chamber and communicating with said chamber through at least one aperture located beneath said fuel in said combustion chamber;

means for receiving said hot combustion gases from said combustion chamber and for further combusting any combustible material entrained in said combustion gases to produce a hot non-combustible gas;

means for selectively mixing a portion of said non-combustible gas with selected amounts of air to heat said air and for supplying said mixture to said plenum for injection into said combustion chamber through said aperture to heat and to dry said fuel in said chamber, said mixing means comprising:

a mixing chamber having an inlet end for receiving said hot non-combustible gas and an outlet end;

a ring actuator at said inlet end of said mixing chamber, said ring actuator including a plurality of rotatable vanes positionable to permit selected amounts of air into said chamber and to impart a swirling motion to said admitted air;

means for supplying said hot non-combustible gases to the center of said ring actuator to enable the mixing of said gases with said swirling air; and a plurality of fixed vanes in said mixing chamber downstream of said ring actuator, said fixed vanes for imparting a swirling motion to said mixture of gases and said swirling air to prevent the formation of hot spots along the surface of said mixing chamber; and a conduit for applying said mixture of air and non-combustible gases to said plenum; and means for sensing the temperature of said swirling mixture of air and non-combustible gases to be supplied to said plenum and for controlling the amount of air mixed with said non-combustible gas to maintain a preselected temperature range for said mixture, said sensing means for controlling said ring actuator to rotate said rotatable vanes in a closing direction to decrease the amount of air admitted into said chamber responsive to the sensed temperature of said mixture of air and non-combustible gases being below said preselected temperature range and to rotate said rotatable vanes in an opening direction responsive to said sensed temperature of said mixture of air and non-combustible gases being above said preselected temperature range.

2. A starved-air combustor according to claim 1 wherein said temperature sensing and controlling means comprises a thermocouple for sensing the temperature of said mixture of air and non-combustible gases supplied to said plenum through said conduit, and a valve in said supplying means for regulating the quantity of hot non-combustible gas supplied to said mixing chamber responsive to said sensed temperature of said mixture to maintain the temperature of said mixture within a preselected temperature range.

* * * * *